US009260900B2

(12) United States Patent
Chen

(10) Patent No.: US 9,260,900 B2
(45) Date of Patent: Feb. 16, 2016

(54) VEHICLE WINDOW LIFTING DEVICE AND INTEGRATED CIRCUIT

(75) Inventor: Xiaoyong Chen, Hunan (CN)

(73) Assignee: Bosch Automotive Products (Changsha) Co. Ltd., Changsha (CN)

( * ) Notice: Subject to any disclaimer, the term of this patent is extended or adjusted under 35 U.S.C. 154(b) by 192 days.

(21) Appl. No.: 14/111,515

(22) PCT Filed: Apr. 12, 2012

(86) PCT No.: PCT/CN2012/073923

§ 371 (c)(1),
(2), (4) Date: Dec. 11, 2013

(87) PCT Pub. No.: WO2012/139509

PCT Pub. Date: Oct. 18, 2012

(65) Prior Publication Data

US 2014/0210381 A1 Jul. 31, 2014

(30) Foreign Application Priority Data

Apr. 15, 2011 (CN) ..... 2011 2 0116172 U

(51) Int. Cl.

| | |
|---|---|
| ***H02P 1/00*** | (2006.01) |
| ***E05F 15/20*** | (2006.01) |
| ***E05F 15/695*** | (2015.01) |
| *E05F 11/38* | (2006.01) |

(52) U.S. Cl.

CPC ..... *E05F 15/20* (2013.01); *E05F 15/695* (2015.01); *E05F 11/382* (2013.01); *E05Y 2800/11* (2013.01); *E05Y 2900/55* (2013.01)

(58) Field of Classification Search

CPC ..... B60J 1/12; B60J 7/0573; H02P 7/0038
See application file for complete search history.

(56) References Cited

U.S. PATENT DOCUMENTS 6,430,716 B1 * 8/2002 Hiramatsu ..... 714/718

FOREIGN PATENT DOCUMENTS

| | | |
|---|---|---|
| CN | 1107623 | 8/1995 |
| CN | 1214407 | 4/1999 |
| CN | 2614150 | 5/2004 |
| CN | 2726934 | 9/2005 |
| CN | 101624890 | 1/2010 |
| CN | 202131878 | 2/2012 |
| JP | 2010077616 | 4/2010 |

OTHER PUBLICATIONS

International Search Report for PCT/CN2012/073923, dated Jul. 19, 2012.

* cited by examiner

*Primary Examiner* — Karen Masih
(74) *Attorney, Agent, or Firm* — Kenyon & Kenyon LLP

(57) ABSTRACT

A window lifter device for driving a motor to control the up and down motion of an automobile window includes: a switch assembly; an up driving circuit for driving the motor to move up the window; a down driving circuit for driving the motor to move down the window; and a control circuit directly coupled between the switch assembly and the up and down driving circuits for controlling the up driving circuit to drive the motor to move up the window when the switch assembly is in a manual up operating state, and controlling the down driving circuit to drive the motor to move down the window when the switch assembly is in a manual down operating state.

8 Claims, 2 Drawing Sheets

VEHICLE WINDOW LIFTING DEVICE AND INTEGRATED CIRCUIT

BACKGROUND OF THE INVENTION

1. Field of the Invention

The present invention relates to an automobile window lifter device, particularly to a low cost automobile window lifter device capable of effectively achieving the basic up and down functions of the window.

2. Description of the Related Art

At present, many automobiles have window lifter devices with analog input control. Generally, these window lifter devices control motors through analog input to move windows up and down. The user operates a switch assembly continuously by, for example, manual up or manual down operations to move the window up or down. Furthermore, the above-mentioned window lifter device is generally equipped with auto down function by which the user may move the window completely down through one time transient operation of the switch assembly.

However, the above-mentioned window lifter device is generally implemented by MCU (microchip unit), which leads to high cost.

BRIEF SUMMARY OF THE INVENTION

In view of the above problem, the present invention provides a window lifter device that can reduce cost while effectively achieving the basic up and down functions of an automobile window.

A window lifter device for driving a motor to control the up and down of an automobile window according to the present invention is characterized by comprising: a switch assembly; an up driving circuit for driving the motor to move up the window; a down driving circuit for driving the motor to move down the window; and a control circuit directly coupled between the switch assembly and the up and down driving circuits for controlling the up driving circuit to drive the motor to move up the window when the switch assembly is in a manual up operating state, and controlling the down driving circuit to drive the motor to move down the window when the switch assembly is in a manual down operating state.

In one embodiment of the present invention, the control circuit includes: a first comparator, wherein a non-inverted input terminal and an inverted input terminal of the first comparator are coupled to a first reference voltage and the switch assembly respectively; a second comparator, wherein a non-inverted input terminal and an inverted input terminal of the second comparator are coupled to a second reference voltage and the switch assembly respectively; a decoder, wherein two input terminals of the decoder are coupled to the output terminal of the first comparator and the output terminal of the second comparator respectively, and an output terminal of the decoder that outputs high level when the switch assembly is in the manual up operating state and an output terminal thereof that outputs high level when the switch assembly is in the manual down operating state are coupled to the up driving circuit and the down driving circuit respectively as a first output terminal and a second output terminal of the control circuit, wherein the inverted input terminal of the first comparator, the inverted input terminal of the second comparator and the switch assembly are coupled together and coupled to a power supply via a resistor.

In another embodiment of the present invention, the up driving circuit includes: a first transistor a base of which is coupled to the first output terminal, the first transistor being turned on to cause the motor to move up the window only when the first output terminal outputs high level, and the down driving circuit comprises a second transistor a base of which is coupled to the second output terminal, the second transistor being turned on to cause the motor to move down the window only when the second output terminal outputs high level.

The window lifter device according to the present invention may further include a self-locking circuit that continuously outputs high level at an output terminal once high level is received at an input terminal, wherein another input terminal other than the two input terminals of the decoder is coupled to the inverted input terminal of the first comparator and the inverted input terminal of the second comparator, the decoder further has an additional output terminal as a third output terminal of the control circuit, which outputs high level when the switch assembly is in an auto down operating state, and the input terminal of the self-locking circuit is coupled to the third output terminal via a first diode, and the output terminal of the self-locking circuit is coupled to the down driving circuit via a second diode.

In another embodiment of the present invention, the self-locking circuit includes: a third transistor; a fourth transistor; and a feedback resistor, wherein a base of the third transistor is coupled to the input terminal of the self-locking circuit directly or via a first resistor and coupled to ground via a second resistor, an emitter of the third transistor is coupled to the ground, and a collector of the third transistor is coupled to a base of the fourth transistor directly or via a third resistor; the base of the fourth transistor is further coupled to a working power supply via a fourth resistor, an emitter of the fourth transistor is also coupled to the working power supply, a collector of the fourth transistor is coupled to the output terminal of the self-locking circuit, and the collector of the fourth transistor is coupled to the input terminal of the self-locking circuit via the feedback resistor to form a feedback loop.

The window lifter device according to the present invention may further include an unlock circuit coupled with the motor and the self-locking circuit, which cuts off the feedback loop to unlock the self-locking circuit when the self-locking circuit is in a self-locking working state and a current of the motor reaches a predetermined threshold.

In another embodiment of the present invention, the up driving circuit comprises a first transistor a base of which is coupled to the first output terminal, the first transistor being turned on to cause the motor to move up the window only when the first output terminal outputs high level, and the down driving circuit comprises a second transistor a base of which is coupled to a second output terminal of the control circuit via a third diode and coupled to the output terminal of the self-locking circuit via the second diode, the second transistor being turned on to cause the motor to move down the window only when the second output terminal of the control circuit or the output terminal of the self-locking circuit outputs high level.

According to another aspect of the present invention, there is provided an integrated circuit including the control circuit, the up driving circuit and the down driving circuit as described in the above embodiments.

The integrated circuit according to the present invention may further include a self-locking circuit having an input terminal coupled to a third output terminal of the control circuit via a first diode, an output terminal coupled to the down driving circuit via a second diode and continuously outputting high level to the down driving circuit once the third output terminal outputs high level.

In the integrated circuit according to the present invention, the self-locking circuit may include: a third transistor; a fourth transistor; and a feedback resistor, wherein a base of the third transistor is coupled to the input terminal of the self-locking circuit directly or via a first resistor and coupled to ground via a second resistor, an emitter of the third transistor is coupled to the ground, and a collector of the third transistor is coupled to a base of the fourth transistor directly or via a third resistor; the base of the fourth transistor is further coupled to a working power supply via a fourth resistor, an emitter of the fourth transistor is also coupled to the working power supply, a collector of the fourth transistor is coupled to the output terminal of the self-locking circuit, and the collector of the fourth transistor is coupled to the input terminal of the self-locking circuit via the feedback resistor to form a feedback loop.

As can be seen from above, the present invention implements a window lifter device with logic circuits of simple structures, thereby effectively reducing cost.

DETAILED DESCRIPTION OF THE INVENTION

Figure 1:
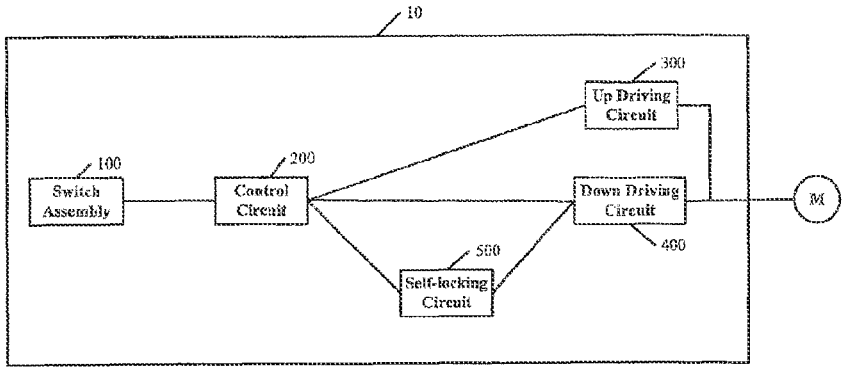
FIG. 1 is a module schematic diagram showing a window lifter device according to one embodiment of the present invention.

FIG. 1 is a structure schematic diagram showing a window lifter device according to one embodiment of the present invention. As shown in FIG. 1, the window lifter device 10 includes a switch assembly 100, a control circuit 200, an up driving circuit 300, a down driving circuit 400 and a self-locking circuit 500.

Among them, the switch assembly 100 may be switch operated by the user and in different operating states depending on different switching operations of the user, e.g., manual up operating state, manual down operating state or Auto Down operating state.

The control circuit 200 is directly coupled to the switch assembly 100. The up driving circuit 300 and the down driving circuit 400 are directly coupled to the control circuit 200, and the self-locking circuit 500 is coupled between the control circuit 200 and the down driving circuit 400. The up driving circuit 300 and the down driving circuit 400 drive a motor M to move up or down the window under the control of the control circuit 200 and the self-locking circuit 500.

Figure 2:
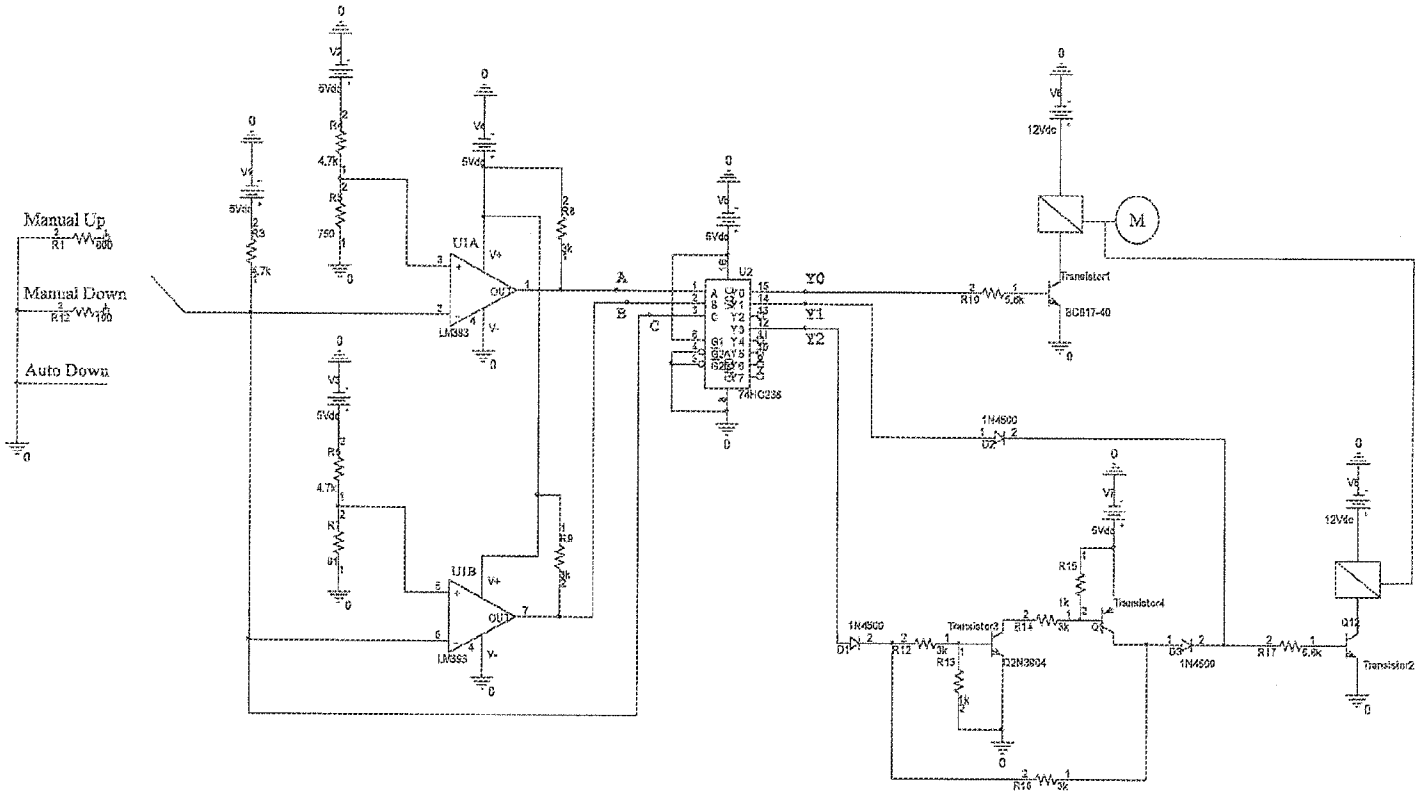
FIG. 2 is a circuit schematic diagram showing a window lifter device according to one embodiment of the present invention.

FIG. 2 is a circuit schematic diagram showing a window lifter device according to one embodiment of the present invention. As shown in FIG. 2, the switch assembly 100 includes a switch K and resistors R1 and R12. When the user operates the switch K to allow it to be connected to ground through the resistor R1, the switch assembly 100 is in the manual up operating state. When the user operates the switch K to allow it to be connected to ground through the resistor R12, the switch assembly 100 is in the manual down operating state. When the user operates the switch K to allow it to be connected to ground directly, the switch assembly 100 is in the auto down operating state.

The control circuit 200 includes a first comparator U1A, a second comparator U1B and 3-8 line decoders U2.

The non-inverted input terminal of the first comparator U1A is coupled to a reference voltage $V_{ref1}$ obtained by dividing the power supply V2 with resistors R4 and R5. The inverted input terminal of the first comparator U1A is coupled to the switch assembly 100. The power supply V4 is coupled to the first comparator U1A to supply an operating voltage to the first comparator U1A and the power supply V4 is also coupled to the output terminal of the first comparator U1A through a pull-up resistor R8.

The non-inverted input terminal of the second comparator U1B is coupled to a reference voltage $V_{ref2}$ obtained by dividing the power supply V3 with resistors R6 and R7. The inverted input terminal of the second comparator U1B is coupled to the switch assembly 100. The power supply V4 is coupled to the second comparator U1B to supply an operating voltage to the second comparator U1B and the power supply V4 is also coupled to the output terminal of the second comparator U1B through a pull-up resistor R9.

Those skilled in the art should understand that, the first comparator U1A and the second comparator U1B shown in FIG. 2 belong to those with an output stage of open-collector structure, therefore the output terminals of the first comparator U1A and the second comparator U1B need to be coupled to the pull-up resistors R8 and R9. However, if the first comparator U1A and the second comparator U1B are those of complementary outputs, the output terminals of the first comparator U1A and the second comparator U1B need not to be coupled to the pull-up resistors R8 and R9.

The input terminals A and B of the 3-8 line decoder U2 are coupled to the output terminal of the first comparator U1A and the output terminal of the second comparator U1B respectively. The output terminals Y0, Y1 and Y3 of the 3-8 line decoder U2 are coupled to the up driving circuit 300, the down driving circuit 400 and the self-locking circuit 500 as the output terminals Y0, Y1 and Y2 of the control circuit 200 respectively. The power supply V5 is coupled to the enable terminal G1 of the 3-8 line decoder U2 to supply operating power to the 3-8 line decoder U2. The enable terminal G2 of the 3-8 line decoder U2 is coupled to the ground.

The switch assembly 100, the inverted input terminal of the first comparator U1A, the inverted input terminal of the second comparator U1B and the input terminal C of the 3-8 line decoder U2 are further coupled together and coupled to the power supply V1 via the resistor R3.

The up driving circuit 300 includes a transistor Transistor1, and the down driving circuit 400 includes a transistor Transistor2.

Among them, the base of Transistor1 is coupled to the output terminal Y0 of the control circuit 200 via the resistor R10 or directly, the collector of Transistor1 is coupled with the driving coil of the motor M, and the emitter of Transistor1 is coupled with the ground.

The base of Transistor2 is coupled to the output terminal Y1 of the control circuit 200 via the resistor R17 or directly via a diode D2, the collector of Transistor2 is coupled with the driving coil of the motor M, and the emitter of Transistor2 is coupled with the ground.

The input terminal of the self-locking circuit 500 is coupled to the output terminal Y2 of the control circuit 200 via a diode D1, the output terminal of the self-locking circuit 500 is coupled to the second transistor Transistor2 through the resistor R17 or directly via the diode D3. Immediately after the output terminal Y2 of the control circuit 200 outputs a high Level, the self-locking circuit 500 continuously outputs a high level to the second transistor Transistor2, even if the output terminal Y2 of the control circuit 200 outputs low level thereafter.

The self-locking circuit 500 includes a transistor Transistor3, a transistor Transistor4 and a feedback resistor R16.

Among them, the base of Transistor3 is coupled to the input terminal of the self-locking circuit 500 via the resistor R12 or directly and coupled to the ground via a resistor R13, the emitter of Transistor3 is coupled to the ground, and the collector of Transistor3 is coupled to the base of the transistor Transistor4 via a resistor R14 or directly.

The base of Transistor4 is further coupled to the power supply V7 via a resistor R15, and the emitter of Transistor4 is also coupled to the power supply V7. The collector of Transistor4 is coupled to the output terminal of the self-locking circuit 500, and the collector of Transistor4 is coupled to the input terminal of the self-locking circuit 500 via a feedback resistor R16 to form a feedback loop.

Referring to FIG. 2 again, when the user switches the switch K to the resistor R1 to make the switch assembly 100 in the manual up operating state, the inverted input terminals of the first comparator U1A and the second comparator U1B and the input terminal C of the decoder U2 are all at low level and higher than reference voltage $V_{ref1}$ and reference voltage $V_{ref2}$. Thereby, the output terminals of the first comparator U1A and the second comparator U1B are both at low level, thus the input terminals A, B and C of the decoder U2 are all at low level. In this case, the output terminals Y0, Y1 and Y3 of the decoder U2 (namely the output terminals Y0, Y1 and Y2 of the control circuit 200) are at high level, low level and low level in turn. Accordingly, Transistor1 in the up driving circuit 300 is turned on, and the Transistor2 in the down driving circuit 400 is turned off. Since Transistor1 is turned on, the motor M is supplied with current to work, thereby lifting the window. Thereafter, when the switch K is released, the inverted input terminals of the first comparator U1A and the second comparator U1B and the input terminal C of the decoder U2 are all at high level and higher than reference voltage $V_{ref1}$ and reference voltage $V_{ref2}$. Thereby, the output terminals of the first comparator U1A and the second comparator U1B are both at low level, thus the input terminals A, B and C of the decoder U2 are at low level, low level and high level in turn. At this point, the output terminals Y0, Y1 and Y3 of the decoder U2 (namely the output terminals Y0, Y1 and Y2 of the control circuit 200) are all at low level, turning off Transistor1 in the up driving circuit 300 and Transistor2 in the down driving circuit 400. The motor M will not be supplied with drive current and stop working, that is, stop lifting the window.

When the user switches the switch K to the resistor R2 to make the switch assembly 100 in the manual down operating state, the inverted input terminals of the first comparator U1A and the second comparator U1B and the input terminal C of the decoder U2 are all at low level and the voltage of the inverted input terminal of the first comparator U1A is higher than reference voltage Vref1 and the voltage of the inverted input terminal of the second comparator U1B is lower than the reference voltage Vref2. Thereby, the output terminal of the first comparator U1A is at low level and the output terminal of the second comparator U1B is at high level, thus the input terminals A, B and C of the decoder U2 are at low level, high level and low level in turn. In this case, the output terminals Y0, Y1 and Y3 of the decoder U2 (namely the output terminals Y0, Y1 and Y2 of the control circuit 200) are at low level, high level and low level in turn. Accordingly, Transistor2 in the down driving circuit 400 is turned on, and the Transistor1 in the up driving circuit 300 is turned off. Since Transistor2 in the down driving circuit 400 is turned on, the motor M is supplied with current to work, so as to move down the window. Thereafter, when the switch K is released, the inverted input terminals of the first comparator U1A and the second comparator U1B and the input terminal C of the decoder U2 are all at high level and higher than reference voltage $V_{ref1}$ and reference voltage $V_{ref2}$. Thereby, the output terminals of the first comparator U1A and the second comparator U1B are both at low level, thus the input terminals A, B and C of the decoder U2 are at low level, low level and high level in turn. At this point, the output terminals Y0, Y1 and Y3 of the decoder U2 (namely the output terminals Y0, Y1 and Y2 of the control circuit 200) are all at low level, turning off Transistor1 in the up driving circuit 300 and Transistor2 in the down driving circuit 400. The motor M will not be supplied with drive current and stop working, that is, stop moving down the window.

When the user switches the switch K to be directly coupled to the ground to make the switch assembly 100 in the auto down operating state, the inverted input terminals of the first comparator U1A and the second comparator U1B and the input terminal C of the decoder U2 are all at low level and lower than reference voltage Vref1 and reference voltage Vref2. Thereby, the output terminals of the first comparator U1A and the second comparator U1B are both at high level, thus the input terminals A, B and C of the decoder U2 are at high level, high level and low level in turn. In this case, the output terminals Y0, Y1 and Y3 of the decoder U2 (namely the output terminals Y0, Y1 and Y2 of the control circuit 200) are at low level, low level and high level in turn. This turns off Transistor1 in the up driving circuit 300 and turns on the diode D1. Thereby, the base of Transistor3 becomes high level to turns it on. Accordingly, the collector of Transistor3 becomes low level to turn on Transistor4, thereby making the collector of Transistor4 become high level and turning on the diode D2 and Transistor2 in the down driving circuit 400. In this way, the motor M is supplied with drive current to move down the window. Thereafter, when the switch K is released, the inverted input terminals of the first comparator U1A and the second comparator U1B and the input terminal C of the decoder U2 are all at high level and higher than reference voltage $V_{ref1}$ and reference voltage $V_{ref2}$. Thereby, the output terminals of the first comparator U1A and the second comparator U1B are both at low level, thus the input terminals A, B and C of the decoder U2 are at low level, low level and high level in turn. At this point, the output terminals Y0, Y1 and Y3 of the decoder U2 (namely the output terminals Y0, Y1 and Y2 of the control circuit 200) are all at low level, turning off Transistor1 in the up driving circuit 300. However, since there is a feedback loop formed by the feedback resistor R16 in the self-locking circuit 500, the base of Transistor3 is still at high level, which maintains Transistor3 and Transistor4, the diode D2 and Transistor2 still turned on and the motor M is continuously supplied with drive current to keep moving down the window.

As can be seen from the above description, the window lifter device of the present invention is implemented with logic circuits of simple structure, thereby reducing cost.

Figure 3:
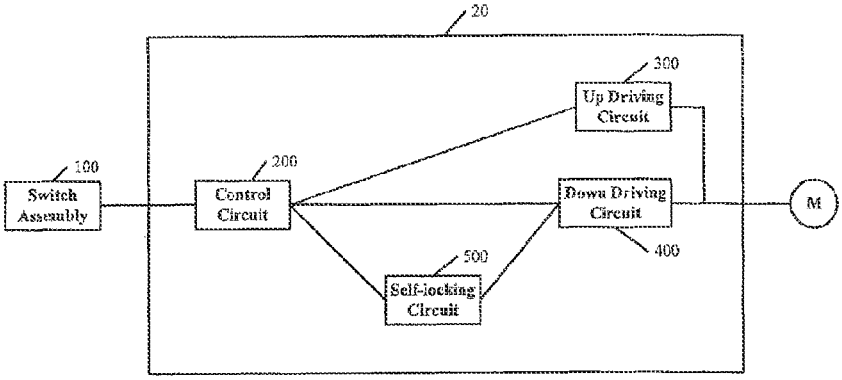
FIG. 3 is a schematic diagram showing an integrated circuit (IC) according to one embodiment of the present invention.

FIG. 3 is a schematic diagram showing an integrated circuit (IC) according to one embodiment of the present invention. As shown in FIG. 3, the integrated circuit 20 includes the aforementioned control circuit 200, up driving circuit 300, down driving circuit 400 and self-locking circuit 500.

Those skilled in the art should understand, although in embodiments described above the window lifter device 10 is set as below: output terminals of the first comparator U1A and the second comparator U1B both being at low level corresponds to the manual up operating state of the switch assembly 100, the output terminal of the first comparator U1A being at low level and the output terminal of the second comparator U1B being at high level corresponds to the manual down operating state of the switch assembly 100, and the output terminals of the first comparator U1A and the second comparator U1B both being at high level corresponds to the auto down operating state of the switch assembly 100, the present invention is not limited to this. In other embodiments of the present invention, it is also possible to set the window lifter device 10 to use other level combinations of output terminals of the first comparator U1A and the second comparator U1B to correspond to various operating states of the switch assembly 100. In this case, the connection relationship between the decoder U2 and the up driving circuit 300, the down driving circuit 400 and the self-locking circuit 500 needs to be set again, to couple the output terminals in the decoder U2 that output high level when the switch assembly 100 is in various operating states to the up driving circuit 300, the down driving circuit 400 and the self-locking circuit 500 as the output terminals of the control circuit 200.

Furthermore, those skilled in the art should understand, although in embodiments described above, the output terminals of the first comparator U1A and the second comparator U1B are coupled to the input terminals A and B of the decoder U2 respectively, the present invention is not limited thereto. In other embodiments of the present invention, it is also possible to connect output terminals of the first comparator U1A and the second comparator U1B to different input terminals of the decoder U2 respectively. In this case, the connection relationship between the decoder U2 and the up driving circuit 300, the down driving circuit 400 and the self-locking circuit 500 needs to be set again, to couple the output terminals in the decoder U2 that output high level when the switch assembly 100 is in various operating states to the up driving circuit 300, the down driving circuit 400 and the self-locking circuit 500 as the output terminals of the control circuit 200.

Furthermore, those skilled in the art should understand, although in embodiments described above, the power supply V1 is also coupled to the input terminal C of the 3-8 line decoder U2 via the resistor R3, the present invention is not limited thereto. In other embodiments of the present invention, it is not necessary to couple the power supply V1 to the input terminal C of the 3-8 line decoder U2 via the resistor R3.

Furthermore, those skilled in the art should understand, although in embodiments described above, the decoder U2 of the window lifter device 10 is a 3-8 line decoder, the present invention is not limited thereto. In other embodiments of the present invention, the decoder U2 of the window lifter device 10 may also be other types of decoders, such as 4-16 line decoder or 5-32 line decoder.

Furthermore, those skilled in the art should understand, when the window is completely moved down, a trap phenomenon occurs on the motor M, which causes large current of the motor M. When the motor M is in trap state for a long time, it will be burnt. With this end in view, in the window lifter device 10 and the integrated circuit 20 of the present invention, there may be also included a unlock circuit coupled with the motor M and the self-locking circuit 500 for detecting whether current in motor M is large and reaches a predetermined threshold when the self-locking circuit 500 is in a self-locking working state, and cutting off the feedback loop in the self-locking circuit 500 when the current in motor M reaches this predetermined threshold to unlock the self-locking circuit 500, thereby the self-locking circuit 500 stops outputting high level to the base of Transistor2, turning off Transistor2, hence the motor M will not be supplied with drive current and stops moving down the window.

Furthermore, those skilled in the art should understand, although in embodiment described above, the switch assembly 100 includes three operating states, manual up, manual down and auto down, the present invention is not limited thereto. In other embodiments of the present invention, the switch assembly 100 may also only include two operating states: manual up and manual down. In case that the switch assembly 100 only includes manual up and manual down, the window lifter device 10 does not include the self-locking circuit 500 and it is not necessary that the power supply V1 is coupled to the input terminal of the 3-8 line decoder U2 via resistor R3.

Furthermore, those skilled in the art should understand, although in embodiments described above, the switch assembly 100 is included in the window lifter device 10, the present invention is not limited thereto. In other embodiments of the present invention, the switch assembly 100 may also not be included in the window lifter device 10. Those skilled in the art should understand, although in embodiments described above, the self-locking circuit 500 is added only in the window auto down operating state; however the self-locking circuit 500 may also be added in the window auto up operating state.

The invention claimed is:

1. A window lifter device for driving a motor to control up and down motions of an automobile window, comprising:

a switch assembly;

an up-driving circuit for driving the motor to raise the window;

a down-driving circuit for driving the motor to lower the window; and a control circuit directly coupled to the switch assembly, the up-driving circuit, and the down-driving circuit, the control circuit being configured to (i) control the up-driving circuit to drive the motor to raise the window when the switch assembly is in a manual up-operating state, and (ii) control the down-driving circuit to drive the motor to lower the window when the switch assembly is in a manual down-operating state, wherein the control circuit includes:

a first comparator, wherein a non-inverted input terminal and an inverted input terminal of the first comparator are respectively coupled to a first reference voltage and the switch assembly;

a second comparator, wherein a non-inverted input terminal and an inverted input terminal of the second comparator are respectively coupled to a second reference voltage and the switch assembly; and a decoder, wherein two input terminals of the decoder are respectively coupled to an output terminal of the first comparator and an output terminal of the second comparator, and a first output terminal of the decoder which outputs a high level when the switch assembly is in the manual up-operating state is coupled to the up-driving circuit as a first output terminal of the control circuit, and wherein a second output terminal of the decoder which outputs a high level when the switch assembly is in the manual down-operating state is coupled to the down-driving circuit as a second output terminal of the control circuit, and wherein the inverted input terminal of the first comparator, the inverted input terminal of the second comparator and the switch assembly are coupled together and coupled to a power supply via a resistor.

2. The window lifter device of claim 1, wherein the up-driving circuit includes a first transistor having a base which is coupled to the first output terminal, the first transistor being turned on to cause the motor to raise the window only when the first output terminal outputs a high level, and wherein the down-driving circuit includes a second transistor having a base which is coupled to the second output terminal, the second transistor being turned on to cause the motor to lower the window only when the second output terminal outputs a high level.

3. The window lifter device of claim 1, further comprising:

a self-locking circuit which continuously outputs a high level at an output terminal once a high level is received at an input terminal;

wherein another input terminal other than the two input terminals of the decoder is coupled to the inverted input terminal of the first comparator and the inverted input terminal of the second comparator;

wherein the decoder includes an additional output terminal as a third output terminal of the control circuit, the third output terminal outputting a high level when the switch assembly is in an automatic down-operating state; and wherein the input terminal of the self-locking circuit is coupled to the third output terminal via a first diode, and the output terminal of the self-locking circuit is coupled to the down-driving circuit via a second diode.

4. The window lifter device of claim 3, wherein the self-locking circuit includes:

a third transistor;

a fourth transistor; and a feedback resistor, wherein a base of the third transistor is coupled to the input terminal of the self-locking circuit one of directly or via a first resistor and coupled to the ground via a second resistor, an emitter of the third transistor is coupled to the ground, and a collector of the third transistor is coupled to a base of the fourth transistor one of directly or via a third resistor; and wherein the base of the fourth transistor is further coupled to a working power supply via a fourth resistor, an emitter of the fourth transistor is also coupled to the working power supply, a collector of the fourth transistor is coupled to the output terminal of the self-locking circuit, and the collector of the fourth transistor is coupled to the input terminal of the self-locking circuit via the feedback resistor to form a feedback loop.

5. The window lifter device of claim 4, further comprising:

an unlock circuit coupled with the motor and the self-locking circuit, wherein the unlock circuit cuts off the feedback loop to unlock the self-locking circuit when the self-locking circuit is in a self-locking working state and a current of the motor reaches a predetermined threshold.

6. The window lifter device of claim 4, wherein the up-driving circuit includes a first transistor having a base which is coupled to the first output terminal, the first transistor being turned on to cause the motor to raise the window only when the first output terminal outputs a high level, and wherein the down-driving circuit includes a second transistor having a base which is coupled to a second output terminal of the control circuit via a third diode and coupled to the output terminal of the self-locking circuit via the second diode, the second transistor being turned on to cause the motor to lower the window when one of the second output terminal of the control circuit or the output terminal of the self-locking circuit outputs a high level.

7. An integrated circuit for a window lifter device for driving a motor to control up and down motions of an automobile window, the window lifter device having a switch assembly, the integrated circuit comprising:

an up-driving circuit for driving the motor to raise the window;

a down-driving circuit for driving the motor to lower the window;

a control circuit directly coupled to the switch assembly, the up-driving circuit, and the down-driving circuit, the control circuit being configured to (i) control the up-driving circuit to drive the motor to raise the window when the switch assembly is in a manual up-operating state, and (ii) control the down-driving circuit to drive the motor to lower the window when the switch assembly is in a manual down-operating state; and a self-locking circuit having an input terminal coupled to a third output terminal of the control circuit via a first diode, an output terminal coupled to the down-driving circuit via a second diode and continuously outputting a high level to the down-driving circuit once the third output terminal outputs a high level.

8. The integrated circuit of claim 7, wherein the self-locking circuit includes:

a third transistor;

a fourth transistor; and a feedback resistor;

wherein a base of the third transistor is coupled to the input terminal of the self-locking circuit one of directly or via a first resistor and coupled to the ground via a second resistor, an emitter of the third transistor is coupled to the ground, and a collector of the third transistor is coupled to a base of the fourth transistor one of directly or via a third resistor; and wherein the base of the fourth transistor is further coupled to a working power supply via a fourth resistor, an emitter of the fourth transistor is also coupled to the working power supply, a collector of the fourth transistor is coupled to the output terminal of the self-locking circuit, and the collector of the fourth transistor is coupled to the input terminal of the self-locking circuit via the feedback resistor to form a feedback loop.

* * * * *